United States Patent [19]

Berns

[11] Patent Number: 4,534,501

[45] Date of Patent: Aug. 13, 1985

[54] DEVICE FOR MARKING THE HEIGHT ABOVE THE FLOOR OF THE EDGES OF ARTICLES OF CLOTHING

[75] Inventor: Harald Berns, Wuppertal, Fed. Rep. of Germany

[73] Assignee: Johann Knupp GmbH & Co., Solingen, Fed. Rep. of Germany

[21] Appl. No.: 357,240

[22] Filed: Mar. 11, 1982

[30] Foreign Application Priority Data

Mar. 21, 1981 [DE] Fed. Rep. of Germany ..... 3111259

[51] Int. Cl.[3] ..... A41H 9/02

[52] U.S. Cl. ..... 227/65; 227/156; 227/132; 33/9 R

[58] Field of Search ..... 33/9 R; 227/65, 120, 227/132, 156

[56] References Cited

U.S. PATENT DOCUMENTS

| | | | |
|---|---|---|---|
| 1,775,357 | 9/1930 | Russell | 227/65 |
| 1,931,195 | 10/1933 | Higgins | 227/65 |
| 2,014,726 | 9/1935 | Flood | 227/65 X |
| 2,659,147 | 11/1953 | Halpin et al. | 227/132 X |
| 3,202,270 | 8/1965 | Schory et al. | 06/56 |
| 3,315,360 | 4/1967 | Tarlow et al. | 33/9 R |
| 3,348,669 | 10/1967 | Powers | 206/56 |
| 3,492,907 | 2/1970 | Hauck | 85/17 |
| 4,050,159 | 9/1977 | Kakinuma | 33/9 R |
| 4,068,783 | 1/1978 | Maier | 33/9 R X |

FOREIGN PATENT DOCUMENTS

| | | | |
|---|---|---|---|
| 244692 | 3/1912 | Fed. Rep. of Germany . | |
| 846280 | 9/1939 | France . | |
| 2335722 | 7/1977 | France . | |
| 512210 | 8/1939 | United Kingdom | 33/9 |

*Primary Examiner*—Paul A. Bell

*Attorney, Agent, or Firm*—Martin A. Farber

[57] ABSTRACT

A device for marking the height above the floor of the edges of articles of clothing in which a force accumulator is charged and released upon actuation of a cloth-pressing lever which drives a pin into the cloth from a pin magazine.

24 Claims, 31 Drawing Figures

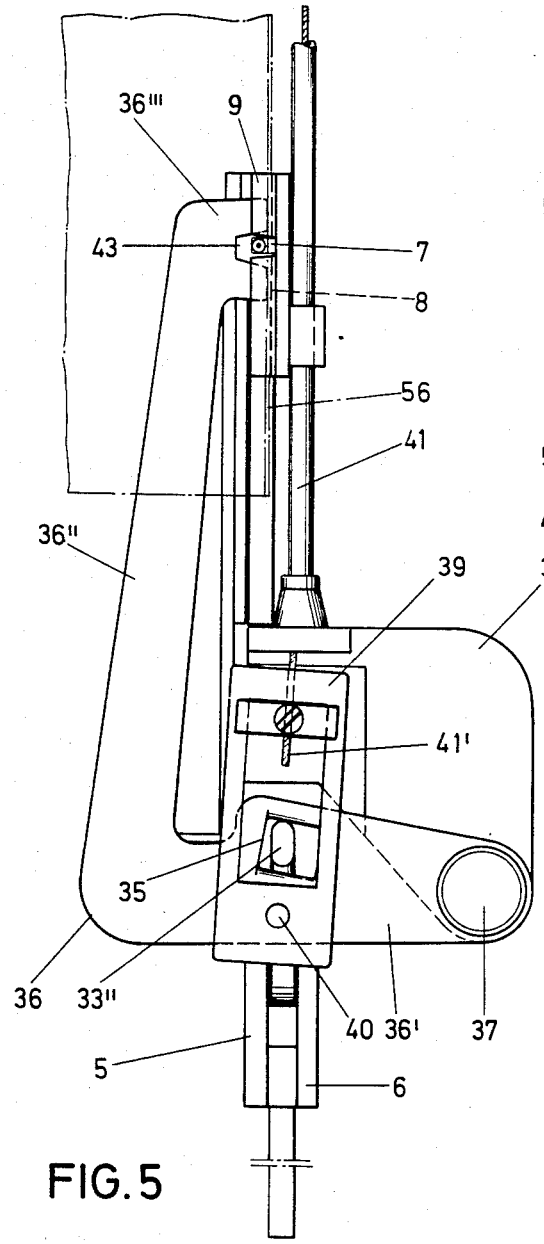
FIG. 5
FIG. 6
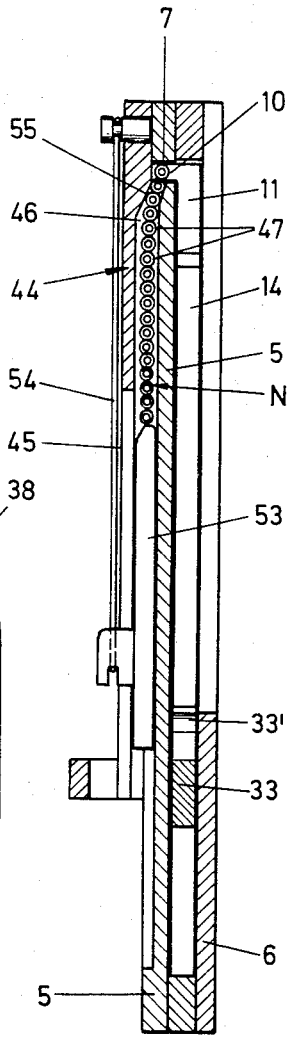

FIG. 10
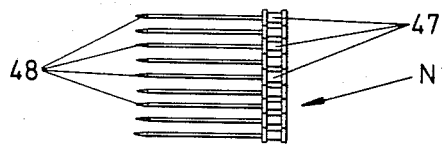
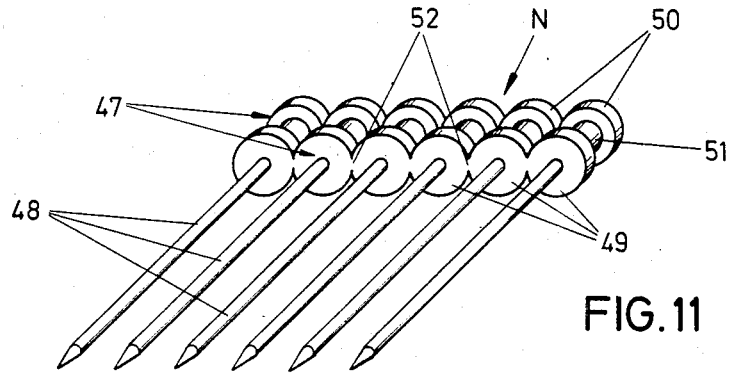
FIG. 11
FIG. 12
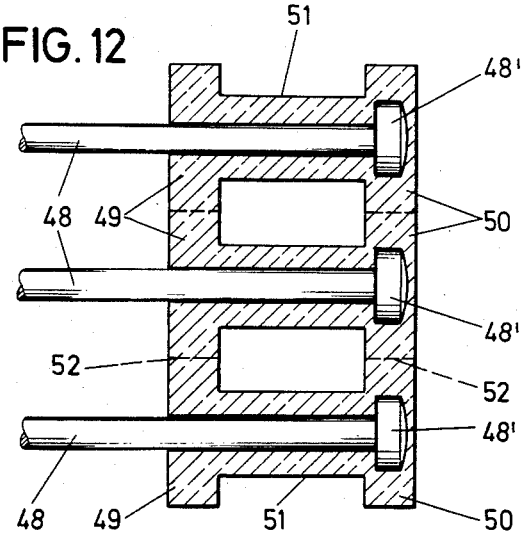
FIG. 13
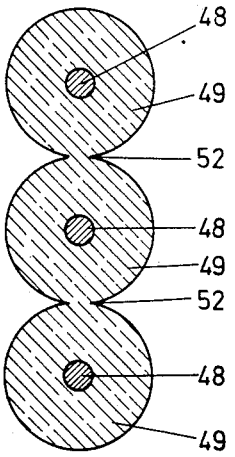

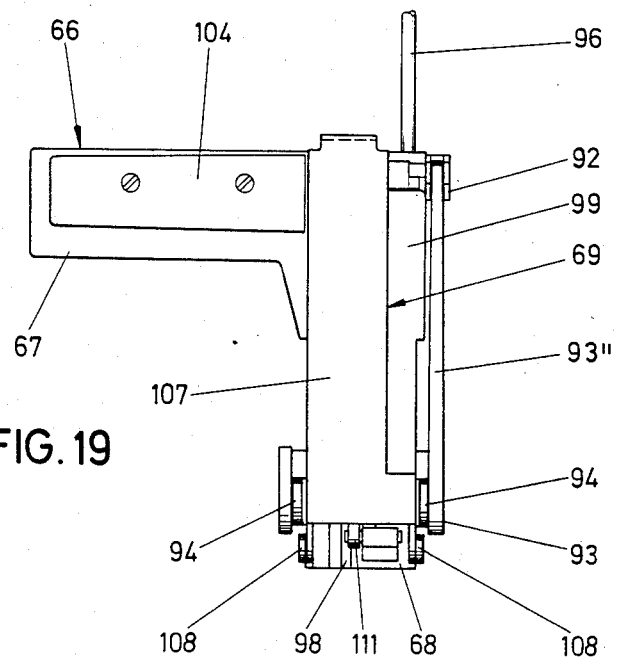
FIG. 19
FIG. 20
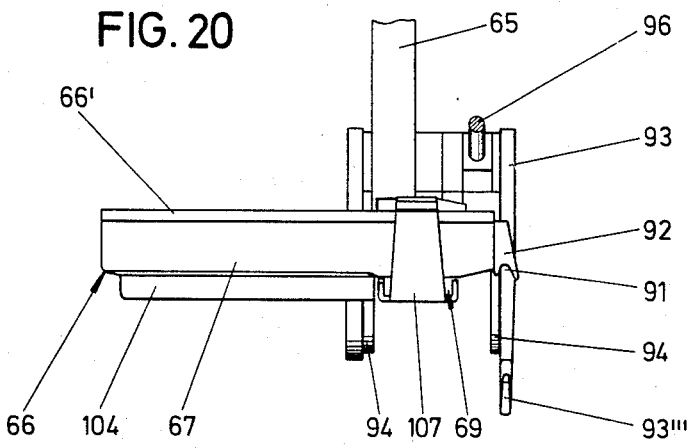

DEVICE FOR MARKING THE HEIGHT ABOVE THE FLOOR OF THE EDGES OF ARTICLES OF CLOTHING

FIELD AND BACKGROUND OF THE INVENTION

The present invention relates to marking devices.

More particularly the invention relates to a device for marking the height above the floor of the edges of articles of clothing having a fabric deflector with a deflection slot and a longitudinal channel transverse to the deflection slot, and a fabric pressing lever which is movable into the deflection slot, the fabric pressing lever having an immersion end portion with a recess which is alignable with the longitudinal channel of the fabric deflector.

One known marking device, as shown in West German AS No. 2 538 751, discloses the use of thread for marking purposes. The thread is withdrawn from a thread roll, passes through a curved needle and upon actuation of a hand lever is pulled by the curved needle, after clamping the edge of an article of clothing, in a deflection slot of the curved needle, through the fabric and cut off. A double-armed fabric-pressing lever is under spring pressure causing a lower lever arm to be continuously pressed against a cam disk. The cam disk is rigidly connected to the handle to enable the fabric-pressing lever to be swung upon turning the handle. The known device also has a thread-clamping member consisting of a clamping bolt and a clamping stop which insures that the desired length of thread remains in the fabric. This device is expensive to manufacture. Furthermore, the needle and thread must continuously pass through the fabric, which can cause problems, especially with thin, densely woven fabrics. Furthermore, the speed of the curved needle is dependent on the speed by which the handle is actuated.

The object of the present invention is to provide a device of the above-mentioned type in a manner which is easy to manufacture and permits delicate marking of the height above the floor of the edges of articles of clothing while maintaining a constant needle speed at all times.

SUMMARY OF THE INVENTION

This object is achieved by a pin magazine shaft extending transversely of the channel and communicating with said channel, and a pin insertion ram movable in said channel, and actuating means operatively engageable with said pin insertion ram for automatically actuating movement of said pin insertion ram, a first movable carriage member supporting said pin insertion ram, said first movable carriage member having a release step, said actuating means, comprising a force accumulator means for acting on said first movable carriage member and for accumulating force with which to move said pin insertion ram, for charging said force accumulator means upon a swinging-in movement of said fabric pressing lever and for operatively releasing said force accumulator means via said release step in an end phase of the swinging-in movement of said fabric pressing lever so as to move said pin insertion ram.

Also this object is achieved according to the invention by a device for marking the height above the floor of the hem of fabric garments, comprising means for deflecting said fabric, means for receiving said deflected fabric, and means for respectively inserting pins into said fabric where each pin insertion is imparted with an equal amount of force, said means for inserting further comprises a first movable carriage member, a pin insertion ram supported on said first movable carriage member, means for accumulating a force and for suddenly releasing said force when a predetermined amount of force has been accumulated so as to move said first movable carriage member.

As a result of these developments a marking device of increased utilitarian value is obtained. The marking is effected in a very delicate fashion since only a thin pin is passed through the fabric. Since this can be done under the action of a force accumulator, the insertion of the pins, after prior release, is at constant speed at all times whether by foot or hand actuation. The size of the force accumulator can be made adjustable. The device is constructed in simple fashion by adding a pin-magazine shaft to a longitudinal fabric-deflection channel which is already present. The pin from a pin magazine which enters the longitudinal channel is then pushed in positive manner by the thread insertion ram through the fabric, which is held in the deflection slot by a fabric-pressing lever.

An advantageous development is represented by the force accumulator being charged upon the inward swinging of the fabric pressing lever. Thus the force accumulator is substantially freed of any load in the basic position of the device. Only after the actuated release and the inward-swinging of the pressing lever which thereby takes place is the force accumulator charged, whereupon it abruptly displaces the insertion ram.

The pin insertion ram is seated on a carriage which is provided with a release step that is acted by the force accumulator. Only after the force accumulator has been sufficiently charged will the release step permit a displacement of the carriage. In this manner the sudden forward movement of the pin-insertion ram is always obtained exclusively by mechanical means.

Furthermore, the pressing lever which can be actuated by a hand lever may be coupled with a transfer carriage that is displaceable against spring load and serves to charge the force accumulator, the force accumulator moving the carriage of the insertion ram via a cam into the rearward basic position. Therefore the apparatus always returns to its starting position after actuation of the hand lever.

It is furthermore advantageous for the transfer carriage to have a driver which serves to displace a release slide that is urged by a spring in the blocking direction. This slide cooperates with release step of the pin-insertion ram. Only after the release slide has been moved a predetermined amount by the transfer carriage via the driver of the transfer carriage can the pin-insertion ram, which is then already under the load of the force accumulator, rapidly move forward.

The pins are assured to reliable guidance by a groove in the pin-magazine shaft that receives the pin heads in the bottom and top surfaces of the magazine.

A modified variant of the device is characterized by two housing legs which are at a right angle to each other, one of the legs containing the pin-magazine shaft while the other leg contains the force accumulator and the needle insertion ram. The construction of the device is thereby more compact with workings that are easy to see. This results in advantages in production and operation.

It is also advantageous for the end of the force accumulator comprising a tension spring, which extends adjacent the needle insertion ram and is parallel to it, to act on a central lever which is supported in the region of the corner of the legs, is coupled to the pressing lever, releases a blocking lever for the needle insertion ram in its final swung position, and is acted on by a return tension spring and which furthermore has a back-pressing stop for the needle insertion ram. The central lever performs a plurality of functions. On the one hand, it represents the part on which the fabric-pressing lever acts. On the other hand, upon its displacement it charges the force accumulator. In addition the central lever also serves to control the blocking lever. The particular alignment of the force accumulator and the arrangement thereof with respect to the needle insertion ram results in an advantageous high speed ejection so that even thick fabrics can be marked without difficulty.

The fact that the force-accumulator spring and the return tension spring are parallel to each other results in advantages in size. After release of the needle insertion ram, the return tension spring always restores the device to its basic position.

In order to be able to load the shaft of the pin magazine in simple fashion, the leg of the housing which has the pin magazine shaft is provided with a closure flap coupled to a feed slide, the spring of which is formed by a spring pull disposed along another arm of the housing. The spring pull, which accordingly can be made with a long length and exerts a uniform pressure on the pins, also urges the closure flap in the closing direction.

The pins are assured accurate guidance since the pin magazine shaft is closed by a strip which can be swung away and only covers a part of the shaft, the strip lying over the length of the magazine shaft with a step in front of the place of transition between the pin head and the pin shaft. Thus the pins are fixed in position in two directions perpendicular to each other.

In order to properly mark fabrics of different thickness with the device, the fabric deflector is arranged for rotation around an axis and is provided with incisions of different depth.

By grouping the pins used in the device within a pin magazine in such a manner that the pins are secured at their heads to form a magazine row, with places of intended rupture, assurance is provided that the device can be easily loaded and each pin can be individually placed, reliably and automatically, through the edge of an article of clothing without any loss of material. When charging the device, a large number of pins can be loaded as a unit, namely as a coherent magazine row. The release of the pins which are to be inserted into the edge of the article of clothing is then effected by the device itself. The points of intended rupture at the head are of such a nature that no separation is brought about upon the customary handling of the magazine row. The separation is effected exclusively by the device and in a manner free of waste. Burrs at the place of rupture do not impair passage through the fabric.

One desirable feature of the pin magazine is the provision of a central circumferential annular groove in the pin heads that connects two end base plates. The places of intended breakage are located exclusively on the base plates. These plates may be of different cross section. The two end base plates enable the pins to be held together at the head end, in all instances, at two places. This results in accurate guidance of the pins, since the turning of the pins with respect to each other is thereby counteracted.

It has been found particularly favorable for the pin heads, which are made of plastic, to be formed as cylinders and connected with each other by webs which form the places of intended breakage, the webs extending in the central plane of the magazine. The cylindrical shape of the pin heads makes it possible to produce small double points of intended breakage which, on the one hand, provide sufficient stability of the magazine row and, on the other hand, permit an easy separation by the marking device of the individual pins to be inserted. The special shape of the pin heads permits a pin shaft of the device to extend in other than a linear direction. There is a flexibility of the magazine row which permits adaption to a different course of a pin magazine shaft. Furthermore, the particular shape of the needle heads assures the advantage of a dependable insertion of the pins into the edge of the article of clothing by the pin insertion ram.

The fact that one base plate surrounds a thickened pin end is also advantageous. The magazine row can thus be manufactured by an extrusion process. The thickened pin end of the pins results in a reliable association of the pins with the pin heads so that the pin heads cannot be withdrawn from the pins but remain in their proper position.

Another variant of the pin magazine is characterized by the width at the places of intended breakage being narrower than the thickness of the base plates. The notch effect is thereby improved, which favors the separation of the specific pin.

A further variation is that the base plates are formed by two depressions with relatively flat bottoms which are arranged on opposite sides of the pin heads in the form of secants to the pin head.

In this connection it is advantageous for the points of intended breakage to be symmetrically between the depressions.

BRIEF DESCRIPTION OF THE DRAWINGS

With the above and other objects and advantages in view, the present invention will become more clearly understood in connection with the detailed description of several preferred embodiments, when considered with the accompanying drawings, of which:

FIG. 5 is a view corresponding to FIG. 2 but after the fabric-pressing lever has been actuated;

FIG. 6 is a cross-section taken along the line VI—VI of FIG. 3;

FIG. 10 shows, in approximately actual size, a view of a pin magazine in accordance with the first embodiment;

FIG. 11 is a perspective view on a larger scale of the FIG. 10 pin magazine;

FIG. 12 is a longitudinal section in greatly enlarged size through the interconnected pin heads;

FIG. 13 is a cross-section through the pin heads;

FIG. 19 is a view of the device viewed in the direction towards the closure flap;

FIG. 20 is a top view of the device;

DETAILED DESCRIPTION OF THE PREFERRED EMBODIMENTS

Figure 1:
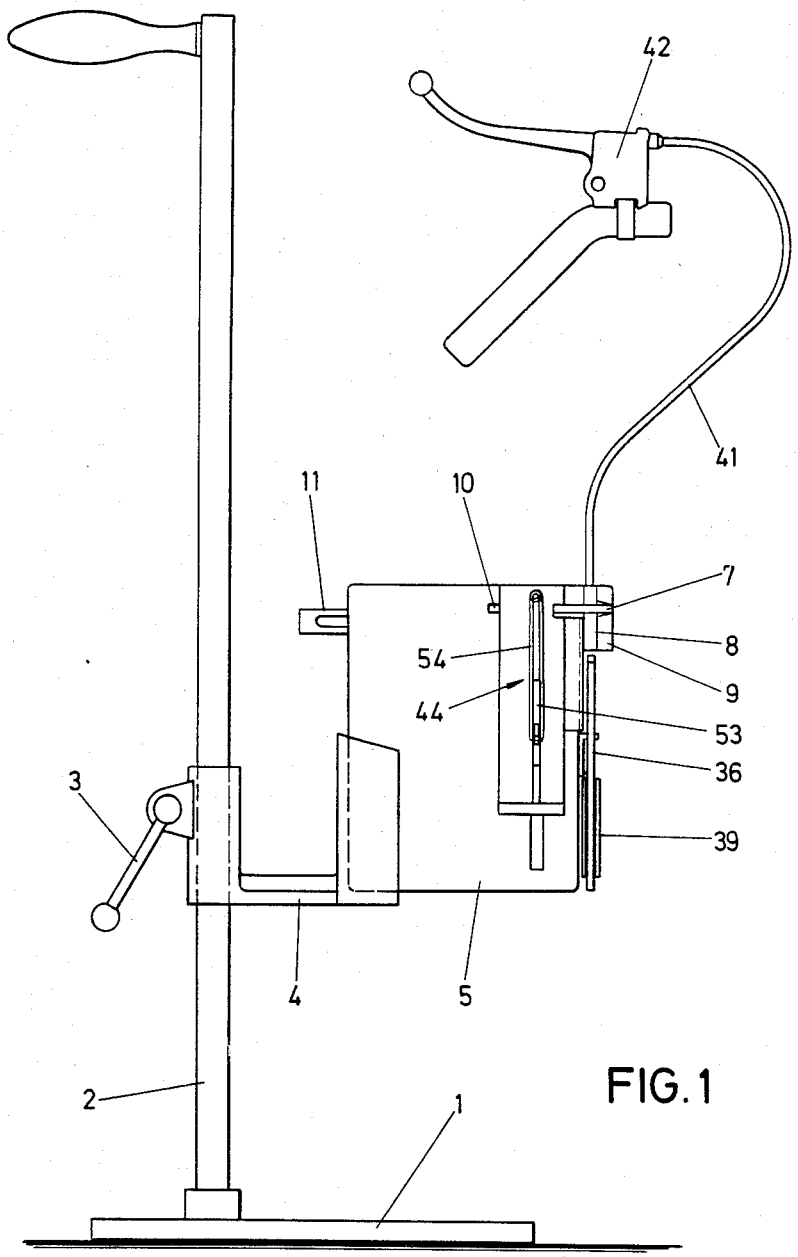
FIG. 1 is a view of the marking device, incorporating one embodiment of the invention, which receives a pin magazine for the marking of the height above the floor of the edges of articles of clothing, the marking device being shown in its basic position.
Figure 2:
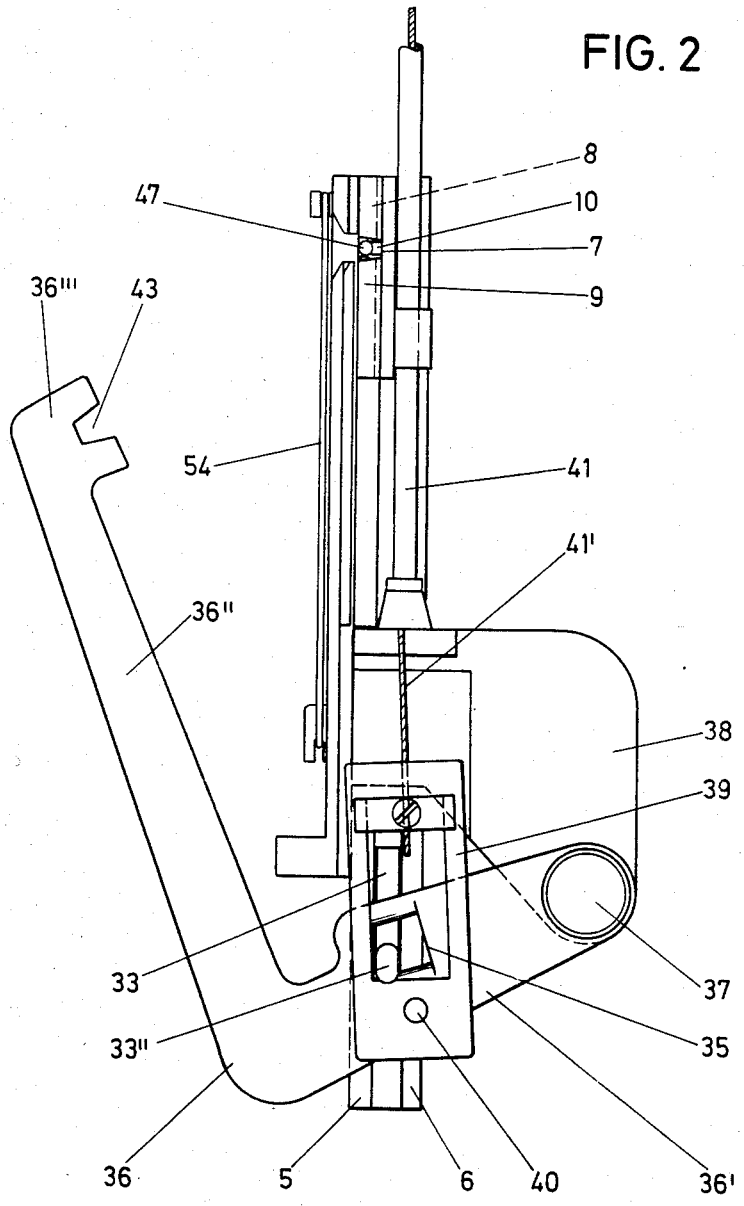
FIG. 2 shows an approximately full-size side view of the marking device, in the region of the fabric-pressing lever, in its starting position.
Figure 3:
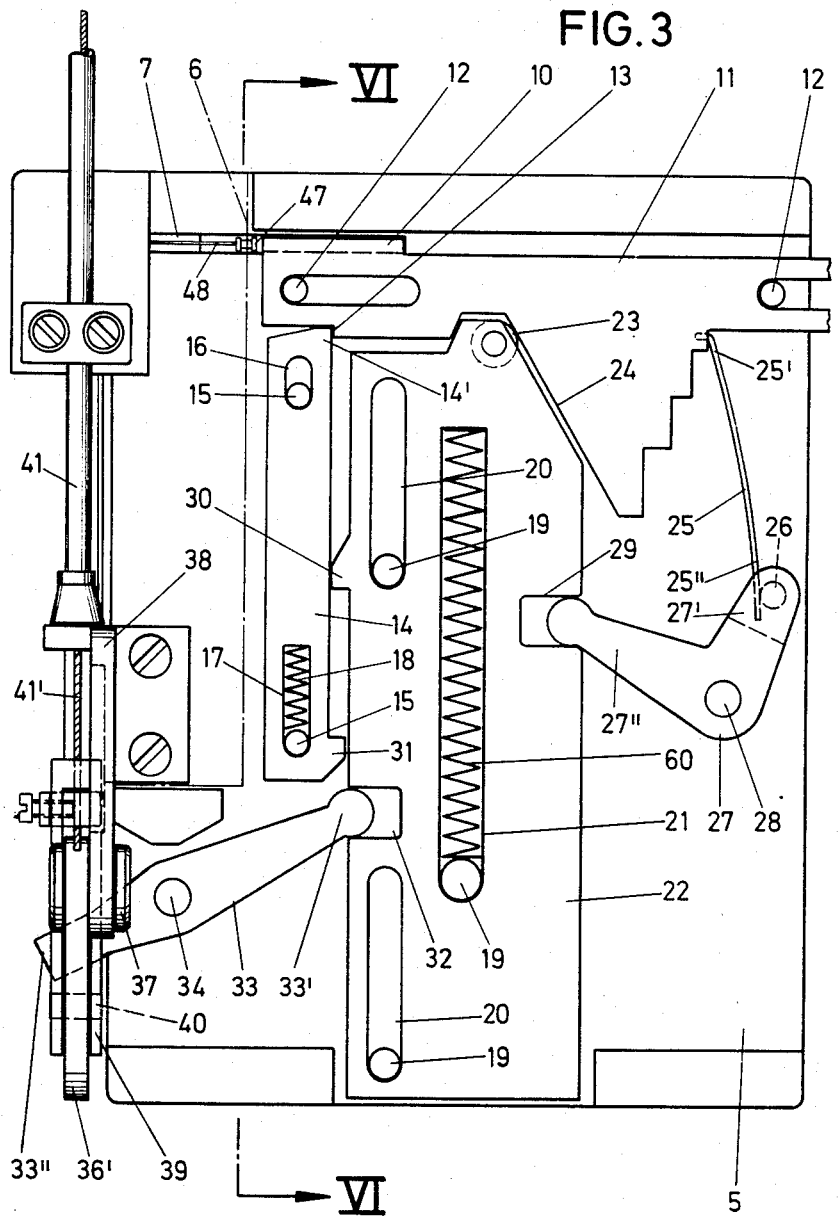
FIG. 3 is a rear view of the marking device, also in its basic position, with the cover plate indicated in dot-dash line.
Figure 4:
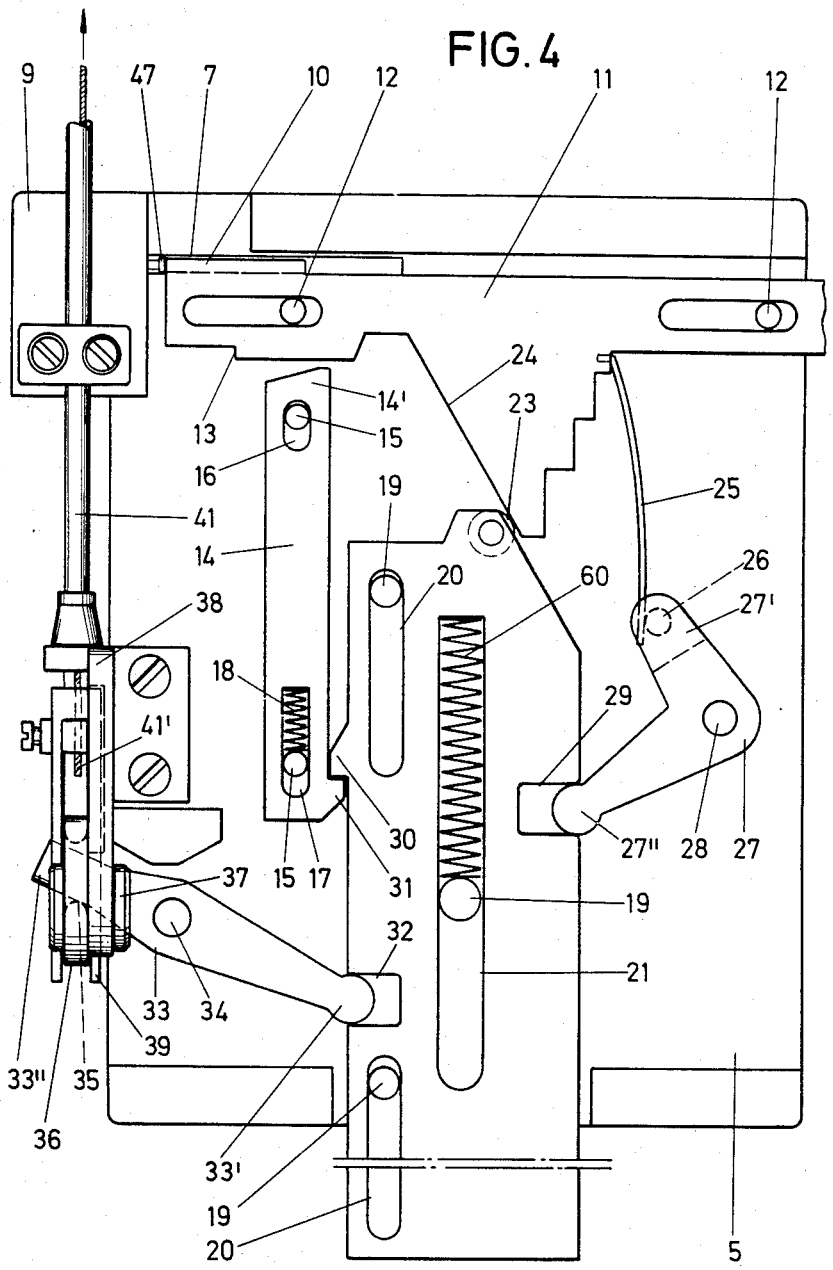
FIG. 4 is a view corresponding to FIG. 3 but after actuation of the hand lever with the pin-insertion ram in its forward position.
Figure 7:
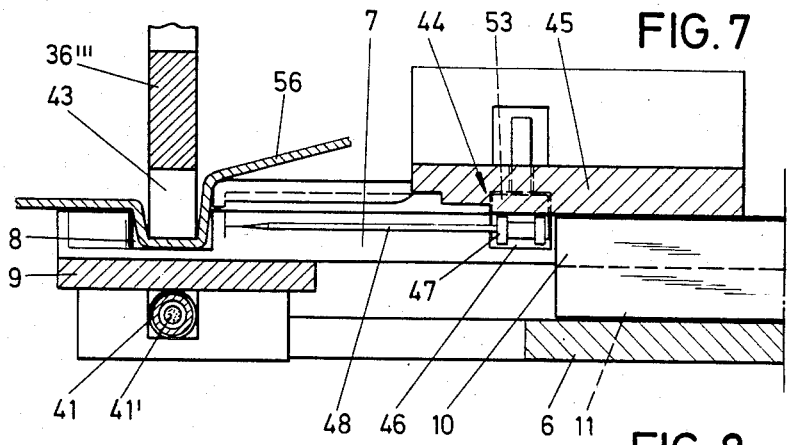
FIG. 7 is a horizontal longitudinal section through the longitudinal channel with the fabric-pressing lever in its active position, the pin-insertion ram having not yet been released.
Figure 8:
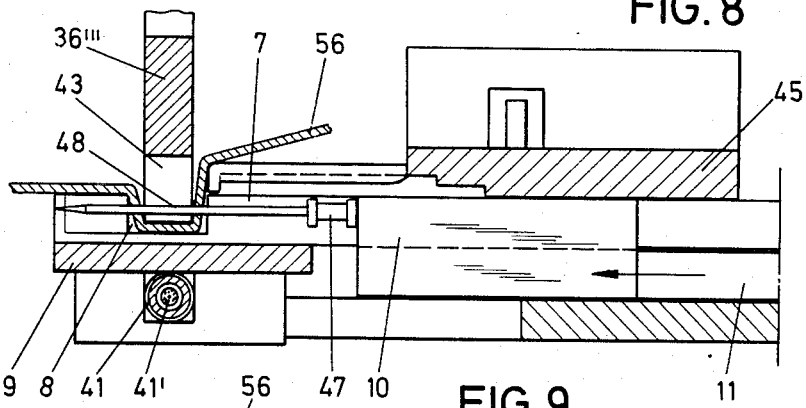
FIG. 8 is a view corresponding to FIG. 7 but after release of the pin-insertion ram which has pushed the pin through the fabric.
Figure 9:
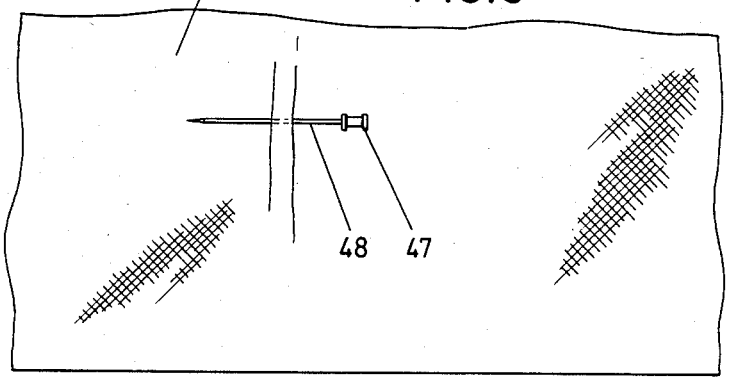
FIG. 9 shows the edge of an article of clothing marked by a pin.

The device shown in FIGS. 1 to 9 comprising a base plate 1 from which a vertically directed column 2 extends. A supporting arm 4 which can be locked by means of a clamping bar 3 and which grips around the lower corner of a bottom plate 5 and cover plate 6, which are parallel to and spaced apart from each other, is guided on the column.

Within the bottom plate 5 there is provided a horizontally extending longitudinal channel 7 which is open towards one side of the bottom plate. This channel intersects a vertically directed deflection slot 8 of the fabric deflector 9 which is formed by a projection on the bottom plate 5. As can be noted particularly clearly from FIGS. 7 and 8, the deflection slot 8 is of lesser depth than the longitudinal channel 7. The bottom plate 5 is thickened in the region of the fabric deflector 9 so that the longitudinal channel 7 is trough-shaped in this region.

A pin insertion ram 10 which is rigidly connected with a horizontally displaceable carriage 11 is guided in the extension of the longitudinal channel 7. Two guide pins 12 which extend from the bottom plate 5 and pass through longitudinal slots of the carriage 11 serve for guiding the carriage. On the side opposite the pin insertion ram 10, the carriage forms a release step 13 in front of which there comes the upper end 14' of a release slide 14 which is movable vertically on studs 15. The studs 15 are also anchored in the bottom plate 5 and extend into slots 16, 17 of the release slide 14. The slot 17 is longer and receives a compression spring 18 which urges the release slide 14 in the blocking direction.

Furthermore, studs 19 extend from the bottom plate 5, these studs passing through vertical slots 20 and 21 of a vertically guided transfer carriage 22. A compression spring 60 is arranged within the vertical slot 21 and urges the transfer carriage in an upward direction. The upper end of the transfer carriage 22 is provided with a roller 23 which via a cam 24 moves the carriage 11 back into the rear basic position shown in FIG. 3. In this position the upper end 14' of the release slide 14 is in front of the release step 13 of the carriage 11.

One end 25' of a force-accumulator spring 25 formed as a leaf spring acts on the rear end of the carriage 11. The other end 25" of the force-accumulator spring 25 rests against a transverse pin 26 of a lever arm 27" of a transfer lever 27 which is of angular shape and is pivotable at its vertex around a support pin 28 arranged on the bottom 5. The longer lever arm 27" of the transfer lever 27 engages into a recess 29 in the edge of the transfer carriage 22. The transfer carriage 22 is provided with a driver 30 on the side thereof opposite the recess 29. A driver projection 31 of the release slide 14 extends into the path of movement of the driver 30, at a distance therefrom.

Below the driver 30 a recess 32 is formed in the edge of the transfer carriage 22. One end 33' of a double-armed control lever 33 which is pivotable around a stationary support pin 34 of the bottom plate 5 engages the recess 32. Another end 33" of the control lever 33 extends into a window-shaped opening 35 of a fabric-pressing lever 36 of angular shape. The window-shaped opening 35 is arranged in the shorter, lower angle leg 36' which is pivotable on one end by means of a pin 37 on an extension 38 which is directed vertically to the bottom plate 5. A fork-shaped transfer member 39 extends around the angle leg 36'. A coupling pin 40 passes through the transfer member 39 and the angle leg 36' of the fabric-pressing lever 36. The core 41' of a Bowden cable 41 acts on the transfer member 39. The Bowden cable leads to a hand lever 42. If the hand lever 42 is actuated, the fabric-pressing lever 36 is swung, and the immersion end 36"' of its longer angle leg 36" enters into the deflection slot 8. Within the immersion end 36"' there is a recess 43 which is open at one end and is aligned in this position—see FIG. 5—with the longitudinal channel 7.

A pin-magazine shaft 44 extends transverse to the longitudinal channel 7 in the extension of which the pin-insertion ram 10 is guided. The shaft is formed by the bottom plate 5 and a shaft wall 45 fastened to the latter. The pin-magazine shaft 44 is provided with a groove 46 in the magazine bottom and top surfaces to receive the pin heads 47 of a pin magazine N.

In accordance with the first embodiment—see FIGS. 10 to 13—the pin heads 47 of the pins 48 are combined to form a magazine row and have a central annular groove 51 which connects two end base plates 49 and 50. The base plates 49, 50, which are of cylindrical shape, are connected tangentially to each other at a place 52 of intended breakage. These places 52 of intended breakage are produced, for instance, upon the extrusion of the plastic pin heads 47.

The pins 48 are provided with a thickened pin end 48' which is surrounded by one base plate 50 upon the extrusion.

Figure 15:
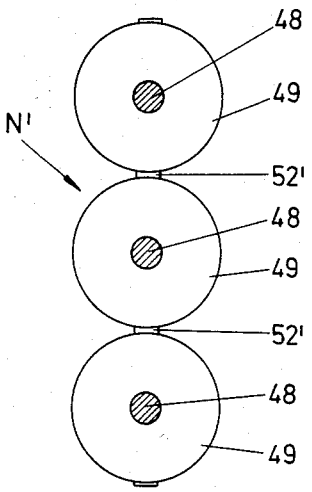
FIG. 15 is a cross-section through the FIG. 14 pin magazine in the region of the pins.
Figure 14:
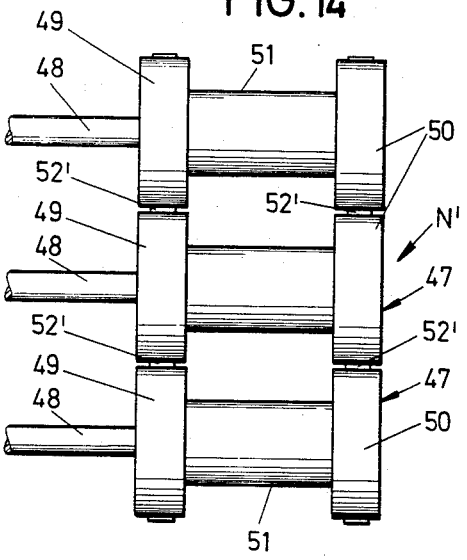
FIG. 14 is a view of a pin magazine in accordance with a second embodiment.

In the second embodiment of the pin magazine N' which is shown in FIGS. 14 and 15, the pin heads are developed in accordance with the preceding embodiment. The same parts, therefore, have the same reference numbers. Differing from the embodiment which has been described above, however, the width of the intended places of breakage 52' is narrower than the thickness of the base plates 49, 50; see in particular FIG. 14. These places of intended breakage can also be produced upon the extrusion of the pin heads 47 which are made of plastic.

Figure 17:
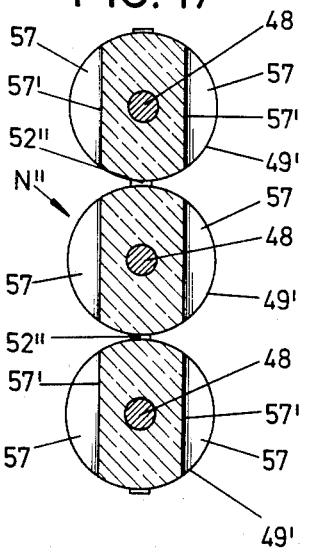
FIG. 17 is a cross-section through the FIG. 16 pin magazine in the region of the depressions on both sides of the pin heads.
Figure 16:
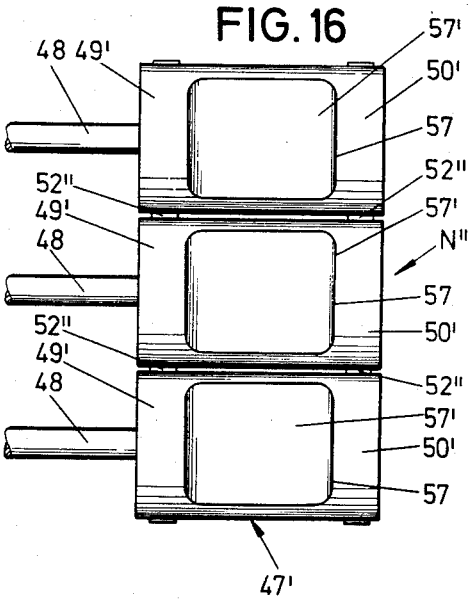
FIG. 16 is a view of a pin magazine in accordance with a third embodiment.
Figure 18:
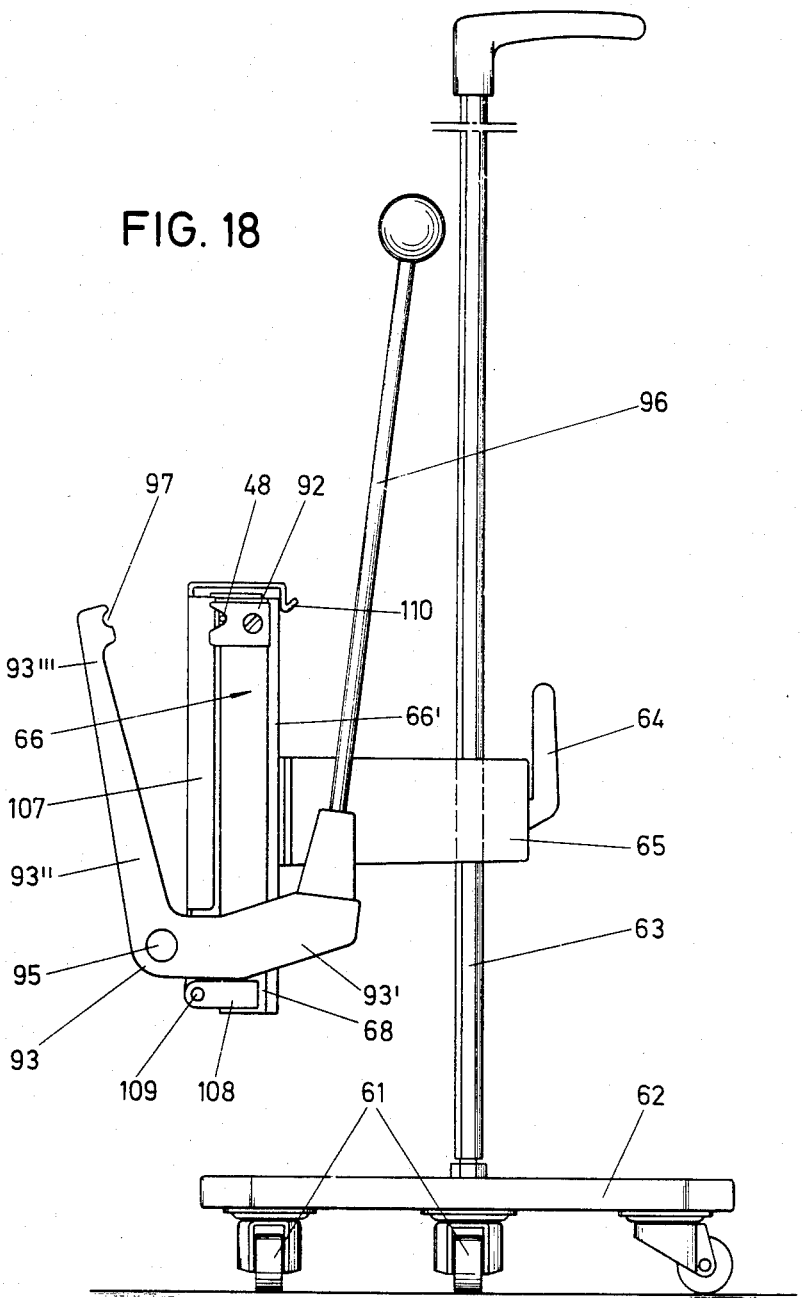
FIG. 18 is a view of the device in accordance with the fourth embodiment, shown in its basic position.
Figure 21:
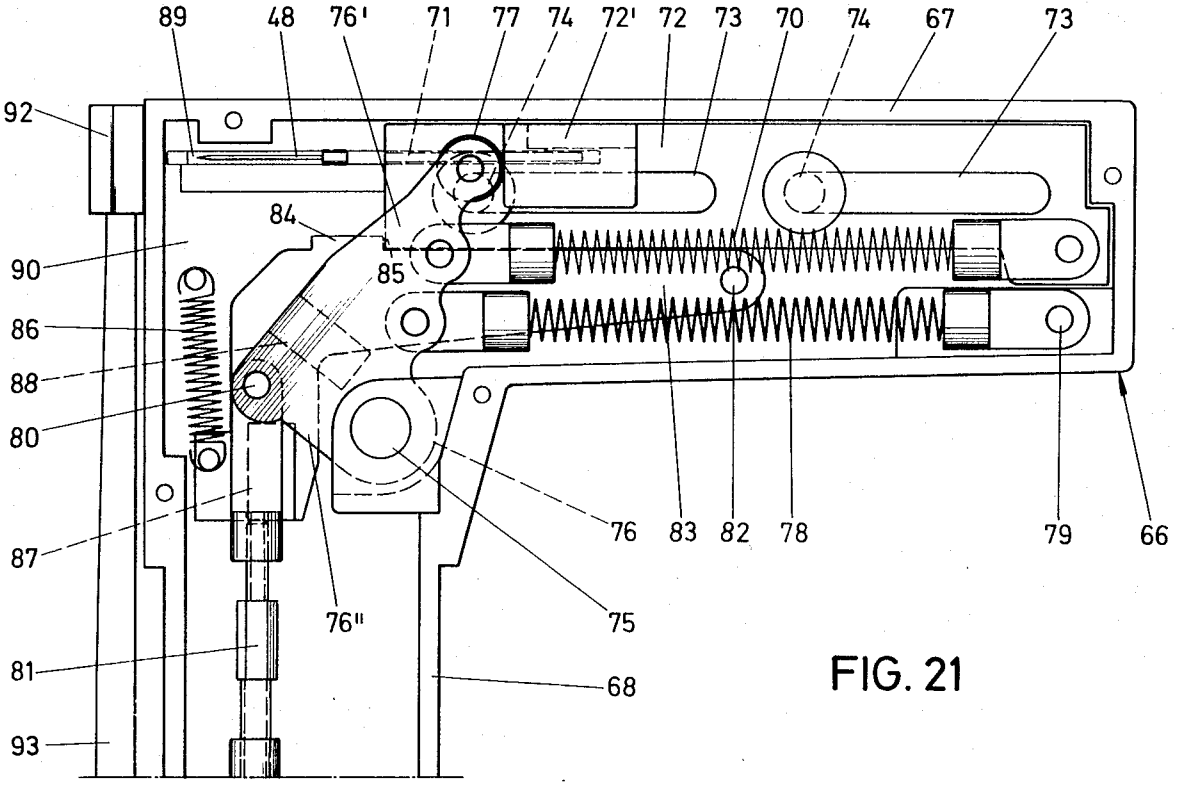
FIG. 21 is a rear view of the device with the cover plate omitted, shown in the basic position.
Figure 22:
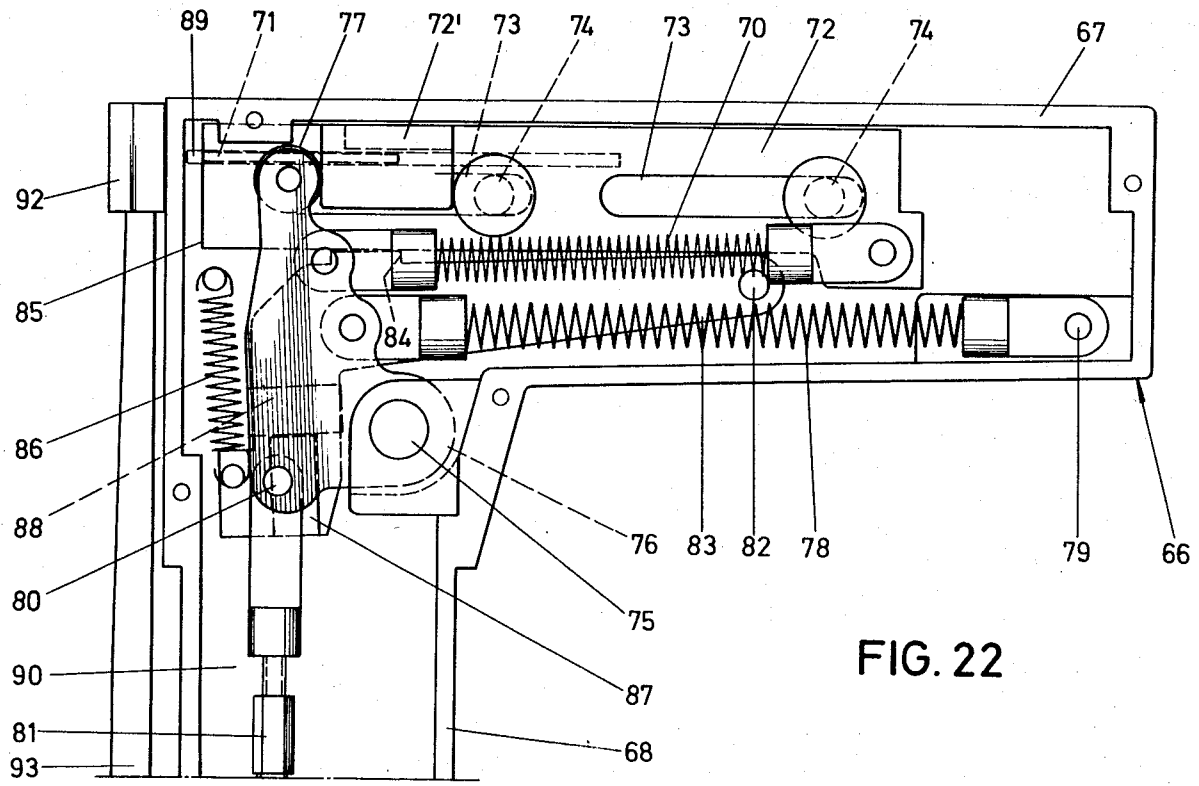
FIG. 22 is a view corresponding to FIG. 21 but with the pin insertion ram pushed forward after actuation of the hand lever.
Figure 23:
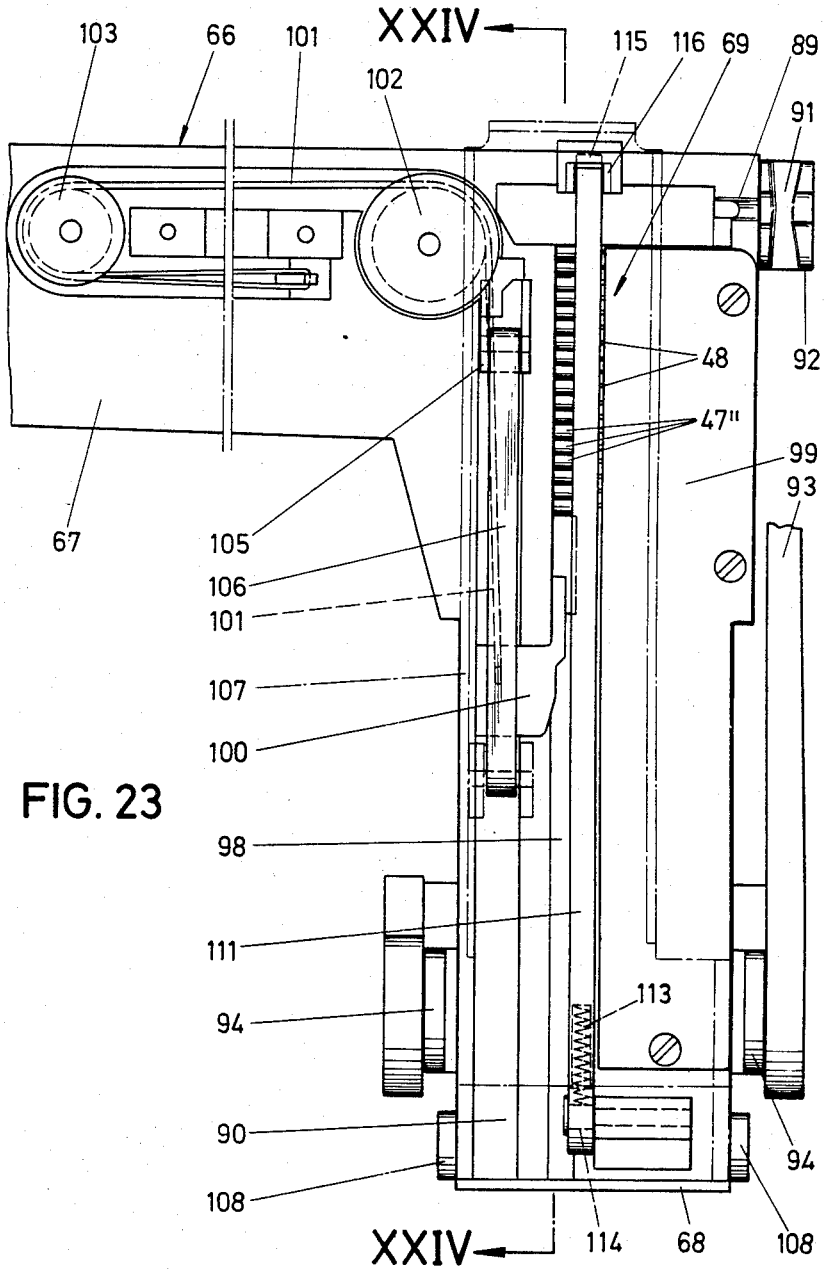
FIG. 23 is a rear view of the device with the closure flap being indicated in dot-dash line.
Figure 24:
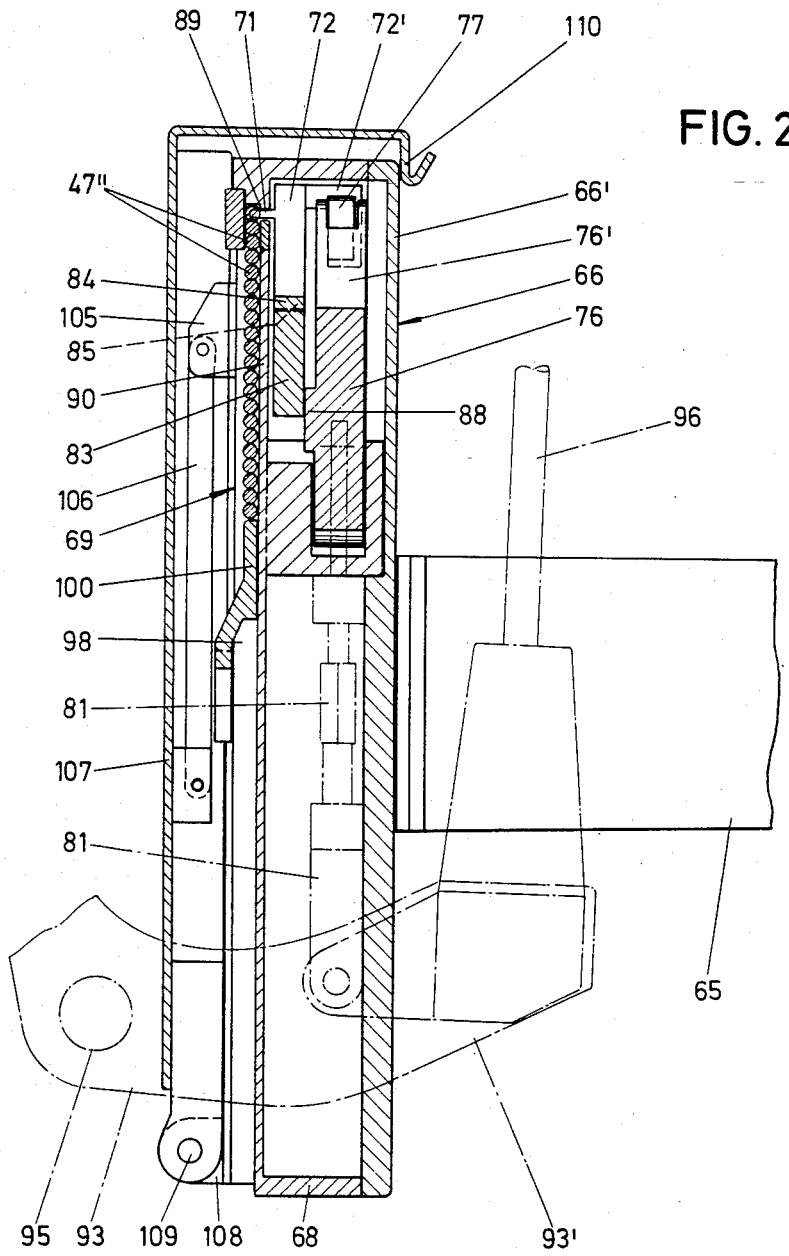
FIG. 24 is a section along the line XXIV—XXIV of FIG. 23.
Figure 25:
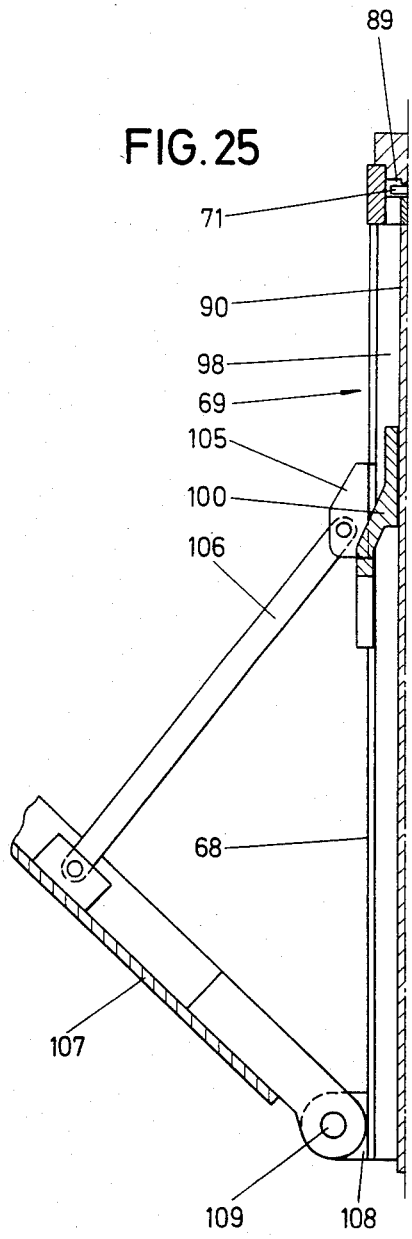
FIG. 25 is a section corresponding approximately to FIG. 24 in which the closure flap has been brought into a partially open position simultaneously carrying along the pin feed slide.
Figure 26:
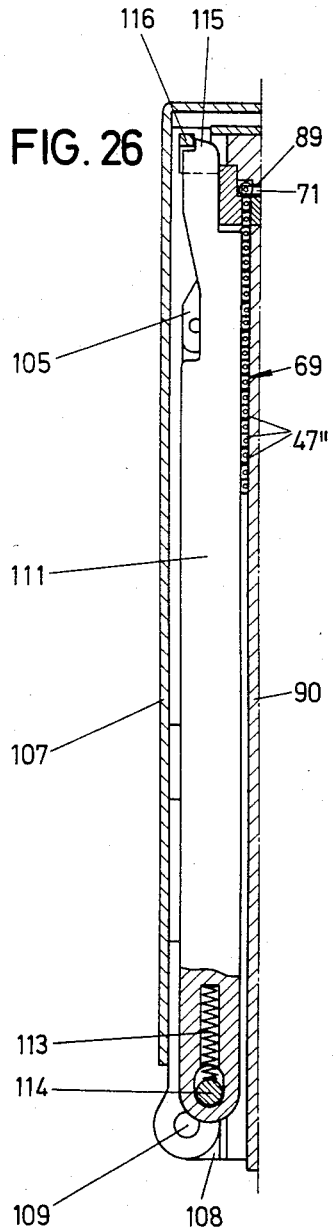
FIG. 26 is a vertical section through the marking device in the region of the strip which supports the pins.
Figure 27:
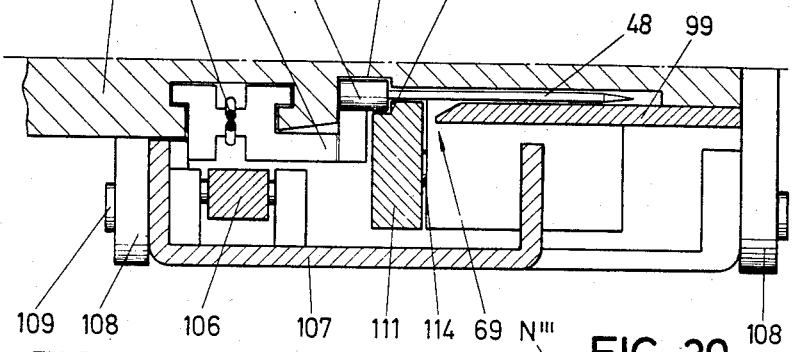
FIG. 27 is a horizontal section through the arm of the housing which has the pin magazine shaft.

FIGS. 16 and 17 show a pin magazine N" with pin heads 47', whose base plates 49', 50' are formed by two depressions 57 arranged on opposite sides and located in the form of a secant with respect to the pin head 47'. The base 57' of these depressions is flat. The base plates 49', 50' are connected to each other by points 52" of intended breakage in such a manner that they lie symmetrically between the depressions 57. The points 52" of intended breakage are also narrower in these variants than the thickness of the base plates 49', 50'.

A pin magazine N comprising a plurality of pins can be inserted into the pin-magazine shaft 44 if the feed slide 53 has been previously drawn out of the groove 46. Upon the insertion of the pin magazine N, the pin heads 47 come into the groove 46 while the shaft wall 45 covers the pins 48. Thereupon the feed slide 53 is inserted into the groove 46. This slide is under the load of an elastic tension member 54 as a result of which the pin magazine N is moved in the direction towards the longitudinal channel 7. The pin head 47 of the uppermost pin is then deflected via an inclined surface 55 into the longitudinal channel 7 so that the pin head 47 is just in front of the pin insertion ram; see FIG. 7.

If the edge 56 of an article of clothing is to be marked with pins, it is advantageous to set the corresponding vertical position by displacing the supporting arm 4 by means of the clamping rod 3. The edge 56 of the article of clothing is then brought into the region of the fabric deflector 9. By actuating the hand lever 42 via the Bowden cable 41, the transfer piece 39 is then moved upwardly, to pivot the fabric pressing lever 36 by means of the coupling pin 40. The control lever 33 which extends into the window-shaped opening 35 is now carried along with the fabric pressing lever 36. The central lever 33 displaces the transfer carriage 22 is a downward direction. Synchronously with the movement of the central lever 33 the transfer lever 27 is pivoted to charge the force-accumulator spring 25. After a corresponding further displacement of the transfer carriage 22, its driver 30 strikes against the driver projection 31 of the release slide 14, the upper end 14' of which moves away from the release step 13 of the carriage 11. The charged force-accumulator spring 25 can now go into action, it in its turn permitting the carriage 11 together with the pin insertion ram 11 fastened thereto to move rapidly forwardly. In this process the pin 48 passes through the edge 56 of the article which is clamped in the deflection slot 8 by the fabric pressing lever 36, resulting in the formation of a loop; see FIGS. 7 to 9. The penetration of the fabric takes place in all cases with the same force and speed.

If the hand lever 42 is no longer acted upon, the compression spring 60 moves the transfer carriage 22 upwardly into the basic position, the carriage 11 being also moved back into its initial position via the roller 23. The release slide 14, the lever 27 and the control lever 33 also return to the starting position, the control lever 33 swinging the fabric-pressing lever 36 into the position shown in FIG. 2. The next pin 48 can now be used for marking.

Upon each advance of the thread insertion ram 10 under the action of the force accumulator spring 25, the upper pin 48 which extends into the longitudinal channel 7 is separated at the point 52 of intended breakage from the adjacent pin.

The device shown in FIGS. 18 to 27 has a base plate 62 which rests on casters 61. The supporting arm 65 is guided on the column 63 of the device and can be clamped in position by means of a clamping lever 64. The supporting arm extends from the cover plate 66' of a housing 66. The housing 66 has two housing legs 67, 68 which are at right angles to each other, the leg 68 containing a pin magazine shaft 69, while the other leg 67 contains a force accumulator 70 and a pin-insertion ram 71.

The pin-insertion ram 71 is seated on a horizontally displaceable carriage 72. Guide pins 74, which are arranged on the housing 66, pass through longitudinal slots 73 in the ram 71 and guide movement of the ram 71. The force-accumulator 70, formed as a tension spring, acts on the rear end of the carriage 72. The other end of the force accumulator 70 leads to a central lever 76 which is mounted around the pin 75 in the corner region of the legs 67, 68. The central lever 76 is a bell-crank lever, the force-accumulator 70 acting on the longer lever arm 76'. A press-back stop formed by a roller 77 is present on the free end of the longer lever arm 76' on the other side of the point of attack of the force accumulator 70 on the central lever 76, said stop as a result of a spring load coming against a control projection 72' on the carriage 72. A return tension spring 78 is arranged below the force-accumulator tension spring 70. The rear end of said return tension spring is fastened to a stud 79 on the housing leg 67. The other end of the return tension spring 78 acts on the longer lever arm 76' of the central lever 76 and urges the lever 76 in a clockwise direction.

The shorter lever arm 76" of the central lever 76 forms a pivot point 80 for a pull rod 81 of adjustable length.

A blocking lever 83 which is pivotable around a pivot pin 82 below the carriage 72 lies, via a blocking shoulder 84, in front of a release step 85 of the carriage 72 in the basic position of the device and thus prevents the carriage 72 from moving forward. The blocking lever 83 is biased by a tension spring 86 which urges the blocking lever 83 in a clockwise direction and thus places the blocking shoulder 84 in front of the release step 85. The blocking lever 83, which is formed in angular shape, has a driver projection 87 on its shorter leg, the projection 87 lying in the path of movement of a driver 88 which is on the side of the central lever 76.

The pin-insertion ram 71 travels in a horizontally extending longitudinal channel 89 of a housing bottom 90 and is directed crosswise to a deflection slot 91 of a fabric deflector 92 which is attached to the housing 66.

The lower end of the pull rod 81 is pivotally coupled to the fabric-pressing lever 93. The lever is of angular shape. The mounting point is at the vertex of the angle so that lugs 94 extending from the vertical housing leg 68 are traversed by pivot pins 95. The shorter lever arm 93' bears an operating rod 96. The longer angle leg 93'' forms the immersion end 93''' which, upon the swinging of the fabric-pressing lever by the operating rod 96, enters into the deflection slot 91 of the fabric deflector 92. Within the immersion end 93''' there is a recess 97 which is open on one side and is aligned with the longitudinal channel 89 in the operating position of the fabric-pressing lever 93.

The pin magazine shaft 69 which opens into the longitudinal channel 89 is provided in the housing bottom 90 with a vertically directed groove 98 to receive the pin heads 47'' of a pin magazine N'''. A cover plate 99 extends over the pin shanks which extend from the pin heads 47''. A feed slide 100 which is mounted on the housing leg 68 presses against the lowest pin head of the pin magazine N''' and thus urges the pins 47'' in the direction towards the longitudinal channel 89. For this purpose, a spring pull 101 placed around two rollers 102 and 103 of the horizontal housing leg 67 acts on the feed slide 100. The other end of this spring pull 101 is fastened near the roller 102. The rollers 102, 103 as well as the corresponding region of the spring pull 101 are covered by a cap 104.

Above the feed slide 100 a release carriage 105 is guided on the vertical housing leg 68. A link 106 is pivoted at one end to the release carriage 105, and is pivoted at its opposite end to a closure flap 107 which extends over the pin-magazine shaft 69. The closure flap 107 is mounted at the lower end of the housing leg 68 around pivot pins 109 which pass through its articulation lugs 108. The end of closure flap 107 which is opposite the pivot point forms a closure hook 110 which in the covering position of the closure flap extends over the upper region of the cover plate 66'.

At the lower end of the housing leg 68 there is mounted a strip 111 which can be pivoted away. The strip 111 covers only a partial region of the groove 98 of the pin magazine shaft 69. On the side facing the pins, the strip 111, which extends over the length of the magazine shaft, has a step 112 which lies in front of the place of transition between the pin head 47'' and pin shank 48; see FIG. 27. The pins are thus fixed in two planes lying perpendicular to each other. The strip 111 is biased by a compression spring 113 which rests at one end against the strip 111 and at the other end against a mounting pin 114 of the strip 111. The strip 111 is thus urged in upward direction. In the position of use an end hook 115 engages behind a blocking projection 116 extending from the housing bottom. The strip 111 may preferably be biased by a spring (not shown) which urges the strip 111 in counterclockwise direction so that the friction exerted on the pins is slight. In order to load the pin magazine shaft 69 it is necessary, after pivoting away the closure flap 107 (see FIG. 25), to displace the strip 111 in a downward direction so that the blocking projection 116 permits the following pivotal movement of the strip 111 in a counterclockwise direction. Upon pivoting of the closure flap 107, the control carriage 105, which is coupled to the closure flap 107 by the link 106, has displaced the feed slide 100 also in downward direction so that a pin magazine N''' can be inserted in unimpeded fashion. After the return movement of the strip 111 and the closure flap 107 into the basic position the device is ready for use.

Upon the pivoting of the fabric-pressing lever 93 by the operating rod 96, the central lever 76 is pivoted via the pull rod 81 in a counterclockwise direction, with simultaneous charging of the force-accumulator tension spring 70 and of the return tension spring 78. The carriage 72 cannot yet move forward during the initial phase. Such movement only becomes possible when the driver 88 of the central lever 76 has displaced the driver projection 87 of the blocking lever 83 to such an extent that its blocking shoulder 84 moves away from the release step 85 of the carriage 72; see FIG. 22. Then, as a result of the charged force-accumulator tension spring 70, the carriage 72, together with the pin insertion ram 71, can move rapidly forward, and a pin which is present in the longitudinal channel 89 is separated from the other pins and introduced into the edge of an article of clothing. After release of the operating rod 96, the return tension spring 78 brings the carriage 72, via the central lever 76, back into the basic portion in which the blocking shoulder 84 of the blocking lever 85 engages the release step 85 of the carriage. The force of the return tension spring 78 is preferably greater than that of the force-accumulator tension spring 70.

Figure 30:
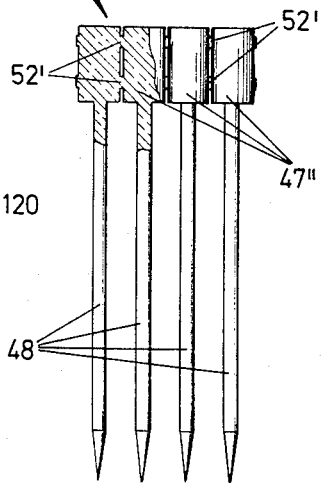
FIG. 30 shows another embodiment of a pin magazine, partially in elevation and partially in section.
Figure 31:
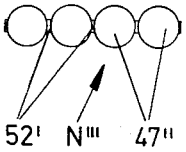
FIG. 31 is a top view of the FIG. 30 pin magazine.

The pin magazine N''' shown in FIGS. 30 and 31 has cylindrical pin heads 47'' which are made of plastic and are connected with each other by webs 52' which form the places of intended breakage. The webs 52' extend in the central plane of the pin magazine N'''. In this instance both the pin heads 47'' and the pin shafts 48 of the pin magazine are extruded out of a single piece of plastic.

Figure 28:
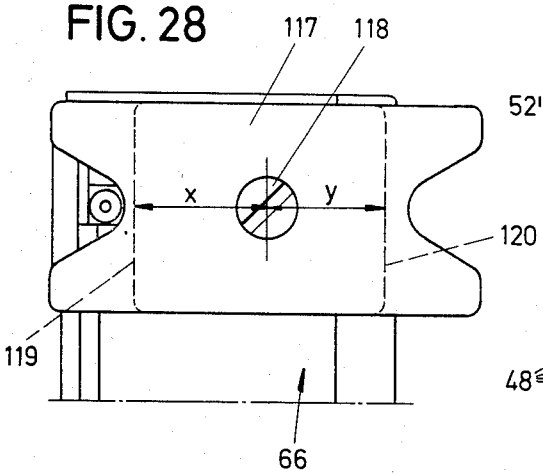
FIG. 28 is a view of the modified fabric deflector which is rotatable about an axis.
Figure 29:
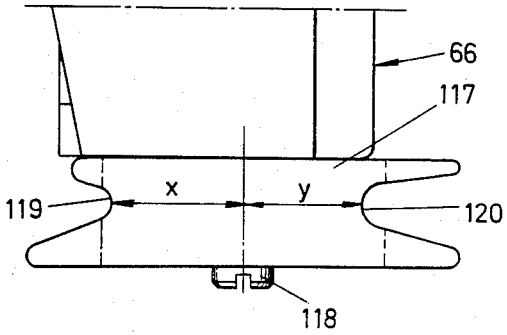
FIG. 29 is a top view of FIG. 28 fabric deflector.

A fabric deflector 117 of a different development is shown in FIGS. 28 and 29. It is arranged for rotation around a journal pin 118. On two opposite sides it is provided with recesses 119 and 120 of different depth and size such that the distance x is greater than the distance y. In the position of use shown in FIGS. 28 and 29 the fabric deflector 117 is adjusted to thinner fabrics. If thicker fabrics are to be provided with pins then the fabric deflector 117 must be turned 180° so that the deflection slot formed by the recess 120 becomes operational. If desired, the fabric deflector 117 can also be provided with additional recesses.

I claim:

1. In a device for marking the height above the floor of the edges of articles of clothing, having a fabric deflector with a deflection slot and a longitudinal channel transverse to the deflection slot, and a fabric pressing lever which is movable into the deflection slot, the fabric pressing lever having an immersion end portion with a recess which is alignable with the longitudinal channel of the fabric deflector, wherein the improvement comprises a pin magazine shaft extending transversely of said channel and communicating with said channel, and a pin insertion ram movable in said channel, and actuating means operatively engageable with said pin insertion ram for automatically actuating movement of said pin insertion ram, a first movable carriage member supporting said pin insertion ram, said first movable carriage member having a release step, said actuating means, comprising a force accumulator means for acting on said first movable carriage member and for accumulating force with which to move said pin insertion ram, for charging said force accumulator means upon a swinging-in movement of said fabric pressing lever and for operatively releasing said force accumulator means via said release step in an end phase of the swinging-in movement of said fabric pressing lever so as to move said pin insertion ram.

2. The device as set forth in claim 1, wherein said actuating means includes force transmission means between said force accumulator means and said fabric pressing lever to permit said force accumulator means to be energized by accumulating force upon said swinging-in movement of said fabric pressing lever in a predetermined direction.

3. The device as set forth in claim 2, wherein said actuating means includes an intermediate transfer carriage member and means for biasing said intermediate transfer carriage member in a first direction, said fabric pressing lever being manually actuatable to move said intermediate transfer carriage member against said biasing means to energize said force accumulator means, a release slide which is spring-loaded in a blocking direction so as to blockingly engage said release step, said intermediate transfer carriage member having a driver for displacing said release slide so as to release said blocking engagement of said release step, and said intermediate transfer carriage member including cam means for moving said first movable carriage member back into a basic start position.

4. The device as set forth in claim 3, wherein said release slide is blockingly engageable with said release step of said first movable carriage member to block movement of said first movable carriage member and so as to prevent the releasing of said force accumulator means and wherein said driver of said intermediate transfer carriage member is engageable with said release slide for displacing said release slide away from its blocking engaging of said first movable carriage member to permit movement of said first movable carriage member by said force accumulator means by thereby releasing said force accumulator means.

5. The device as set forth in claim 1, wherein said pin magazine shaft comprises a receiving area and a groove sized to accommodate pin heads, said groove being cross-sectionally larger than the cross-section of said receiving area.

6. The device as set forth in claim 1, further comprising two housing legs disposed perpendicular to each other, the first housing leg containing said pin magazine shaft and the second housing leg containing said force accumulator means and said pin-insertion ram.

7. The device as set forth in claim 6, wherein said force accumulator means comprises a tension spring extending adjacent said pin-insertion ram and being disposed parallel to said pin-insertion ram, said device further including a central lever supported substantially at the intersection of said legs, with one end of said tension spring engaging said central lever, and a blocking lever for blocking travel of said pin-insertion ram, said central lever being coupled to said fabric pressing lever, said central lever having a first limit position for disengaging said blocking lever from blocking travel of said pin-insertion ram, said central lever being biased by a return biasing means and having a stop portion for engagement with said pin-insertion ram.

8. The device as set forth in claim 6, wherein said force accmulator means and said return biasing means are springs that extend parallel to each other.

9. The device as set forth in claim 6, wherein said first housing leg includes a closure flap and a feed slide member movably coupled to said closure flap, said feed slide member being biased in a first direction by a spring pull member joined to said second housing leg.

10. The device as set forth in claim 9, wherein said pin magazine shaft is covered by a strip member pivotable away from said pin magazine shaft, said strip member covering the length of said pin magazine shaft but extending only a portion of the width of said pin magazine shaft, said strip member including a step at a predetermined location defined to locate in front of a transition point between the head and the shaft of a pin.

11. The device as set forth in claim 1, wherein said fabric deflector is rotatable around a predetermined axis and defines recesses of different depth in its side walls.

12. A device for marking the height above the floor of the hem of fabric garments, comprising:

means for deflecting said fabric, means for receiving said deflected fabric, and means for respectively inserting pins into said fabric where each pin insertion is imparted with an equal amount of force, said means for inserting further comprises a first movable carriage member, a pin insertion ram supported on said first movable carriage member, means for accumulating a force and for suddenly releasing said force when a predetermined amount of force has been accumulated so as to move said first movable carriage member.

13. The device of claim 12, wherein said means for accumulating and releasing the force is adjustable to enable accumulation and release of a selected predetermined force.

14. The device of claim 12, wherein said means for accumulating and releasing comprises a force accumulator and a transfer carriage member.

15. The device of claim 14, wherein said force accumulator comprises a leaf spring.

16. The device of claim 14, wherein said means for deflecting comprises a fabric pressing lever, and wherein said force accumulator is charged upon a swinging-in movement of said fabric pressing lever via said transfer carriage member and is released via said transfer carriage member in a predetermined position of an end phase of said swinging-in movement.

17. The device of claim 16, wherein said means for deflecting comprises a fabric pressing lever, said device further comprising means for biasing said transfer carriage member in a first direction, said fabric pressing lever being manually actuatable to move said transfer carriage member against said means for biasing to energize said force accumulator.

18. The device of claim 17, wherein said transfer carriage member comprises cam means for moving said first moveable carriage member into a basic start position.

19. The device of claim 16, further comprising a release slide engageable with said first movable carriage member to block movement of said first movable carriage member so as to prevent release of said force accumulator and wherein said transfer carriage member includes a driver portion engageable with said release slide for displacing said release slide away from its blocking of said first movable carriage member to permit movement of said first movable carriage member by said force accumulator, wherein said moving away from blocking of said first movable carriage member releases said force accumulator.

20. The device of claim 19, wherein said means for deflecting comprises a deflection slot, said device further comprising a longitudinal channel transverse to said deflection slot, and a pin magazine shaft extending transverse of said longitudinal channel, said pin insertion ram being moveable in said longitudinal channel.

21. The device of claim 20, wherein said pin magazine shaft comprises a receiving area and a groove sized to accommmodate pin heads, said groove being cross-sectionally larger than the cross-section of said receiving area.

22. The device of claim 12, wherein said means for deflecting comprises a deflection slot, said device further comprising a longitudinal channel transverse to said deflection slot, a pin magazine shaft extending transverse of said longitudinal channel, said pin insertion ram moveable in said longitudinal channel; and two housing legs disposed perpendicular to each other, the first leg containing said pin magazine shaft and the second leg containing said force accumulator and said pin-insertion ram.

23. The device of claim 22, wherein said first moveable carriage member comprises a horizontally displaceable carriage, and wherein said force accumulator comprises a tension spring extending adjacent said pin-insertion ram and being disposed parallel to said pin-insertion ram, said device further including a central lever supported substantially at the intersection of said legs, with one end of said tension spring engaging said central lever, and a blocking lever for blocking travel of said pin-insertion ram, said central lever being coupled to said fabric pressing lever, said central lever having a first limit position for disengaging said blocking lever from blocking travel of said pin-insertion ram, said central lever being biased by a return biasing means and having a stop portion for engagement with said pin-insertion ram.

24. The device of claim 22, wherein said force accumulator and said return biasing means are springs that extend parallel to each other, wherein said first housing leg includes a closure flap and a feed slide member movably coupled to said closure flap, said feed slide being biased in a first direction by a spring pull member joined to said second housing leg, and wherein said pin magazine shaft is covered by a strip member pivotable away from said pin magazine shaft, said strip member covering the length of said pin magazine shaft but extending only a portion of the width of said pin magazine shaft, said strip member including a step at a predetermined location defined to locate in front of a transition point between the head and the shaft of a pin.

* * * * *